US011728561B2

(12) United States Patent
Nyström

(10) Patent No.: US 11,728,561 B2
(45) Date of Patent: Aug. 15, 2023

(54) SUBSTRATE INTEGRATED MULTI BAND INVERTED F ANTENNA

(71) Applicant: ASCOM (SWEDEN) AB, Gothenburg (SE)

(72) Inventor: Mikael Nyström, Gothenburg (SE)

(73) Assignee: ASCOM (SWEDEN) AB, Gothenburg (SE)

( * ) Notice: Subject to any disclaimer, the term of this patent is extended or adjusted under 35 U.S.C. 154(b) by 380 days.

(21) Appl. No.: 17/077,415

(22) Filed: Oct. 22, 2020

(65) Prior Publication Data

US 2021/0126346 A1 Apr. 29, 2021

(30) Foreign Application Priority Data

Oct. 23, 2019 (EP) ..... 19204929

(51) Int. Cl.

| | |
|---|---|
| ***H01Q 1/24*** | (2006.01) |
| ***H01Q 1/38*** | (2006.01) |
| ***H01Q 1/22*** | (2006.01) |
| ***H01Q 7/02*** | (2006.01) |

(52) U.S. Cl.

CPC ..... *H01Q 1/243* (2013.01); *H01Q 1/2225* (2013.01); *H01Q 1/38* (2013.01); *H01Q 7/02* (2013.01)

(58) Field of Classification Search

CPC .. H01Q 1/24; H01Q 1/22; H01Q 1/38; H01Q 7/02; H01Q 5/328; H01Q 5/364; H01Q 9/42; H01Q 9/0421; H01Q 5/307

See application file for complete search history.

(56) References Cited

U.S. PATENT DOCUMENTS

| | | | | |
|---|---|---|---|---|
| 2009/0135087 | A1* | 5/2009 | Gummalla | H01Q 15/0086 343/909 |
| 2015/0236417 | A1* | 8/2015 | Lellci | H01Q 5/328 343/700 MS |
| 2017/0162948 | A1* | 6/2017 | Wong | H01Q 5/10 |
| 2018/0083353 | A1* | 3/2018 | Tseng | H01Q 5/364 |
| 2020/0176857 | A1* | 6/2020 | Ahola | H01Q 1/04 |

OTHER PUBLICATIONS

European Search Repod for Application No. 19204929.4, entitled "Substrate integrated multi band inverted F antenna," dated Mar. 23, 2020, pp. 1-9.

* cited by examiner

*Primary Examiner* — Ricardo I Magallanes

(74) *Attorney, Agent, or Firm* — Hamilton, Brook, Smith & Reynolds, P.C.

(57) ABSTRACT

The present disclosure provides an antenna for wireless communication that includes a first planar conductor, which is adapted to resonate at frequencies of a first frequency range; and a second planar conductor, which is adapted to resonate at frequencies of a second frequency range that spans lower frequencies than the first frequency range. Thus, a compact and efficient antenna layout is provided that enables reception and transmission of radio signals on multiple frequency bands.

20 Claims, 7 Drawing Sheets

SUBSTRATE INTEGRATED MULTI BAND INVERTED F ANTENNA

RELATED APPLICATION

This application claims priority under 35 U.S.C. § 119 or 365 to European, Application No. 19204929.4, filed Oct. 23, 2019. The entire teachings of the above application are incorporated herein by reference.

TECHNICAL FIELD

The present technology is related to antennas that are capable of receiving and transmitting wireless signals and specifically planar antennas that are capable of receiving and transmitting on one or more frequency bands.

BACKGROUND

With the ever-increasing complexity of devices and the need for devices to be able to receive data from or transmit data to networks, there has been a large demand for simple and cost-effective transmission means, i.e. antennas. Due to strict regulation of the commercially usable frequencies, which may differ vastly throughout various regions in the world, and the need to stay connected anywhere, the need for these cost-effective transmission means to be able to cope with a number of different frequency ranges for data transmission and reception has increased similarly. With the definition of new standards for wireless communications, the usable frequency bands also changed, further increasing the need to handle a wide range of frequency bands. To be able to suit the demands of users for more attractive designs that are particularly characterized by very efficient use of a compact form factor, reducing space requirements has become another major criterion for the design of modern devices. Even then high performance and low energy consumption are expected in order to preserve battery life of mobile devices into which the antennas are integrated.

In spite of the effort already invested in the development of antennas for wireless communication further improvements are desirable.

Antennas of the inverted F type have been commonly used for purposes of wireless communication. Such antennas rely on a radiation element which runs in parallel along a grounding plane. Typical variations are arranged on printed circuit boards, PCBs, that include a ground plane. On one end of the radiation element the antenna is grounded to the ground plane, while the antenna is fed from an intermediate point in between the two ends of the radiation element. This allows for preserving space, while also enabling designers of these antennas to handle impedance matching and tuning of the radiation characteristics by means of the layout characteristics, such as length of the radiation element, as well as distance of the grounding and feeding point from each other and with respect to the length of the radiation element.

When reception or transmission of more than just frequencies of one frequency band, i.e. a specific and limited range of frequencies, is required, antennas of the inverted F type are inherently limited by their respective layout characteristics. This has been addressed by including more than just one antenna, which also involves the use of additional circuitry, such as impedance matching circuitry for the different antennas and various circuitry included in the feeding and grounding legs of the antennas. This results in the disadvantage that the additional circuitry and components lead to increased space and material requirements, which also lead to increased weight and cost of production due to more material and components being necessary. Performance is also impaired, because each component in an electric circuit adds losses by means of its conductive elements alone, but also because ideal conditions for operation of an antenna require that the antenna is surrounded by as much air as possible. When the latter is given, a maximum amount of radio waves are emitted from the radiation element and thus transferred into the surrounding space and towards a potential receiver. In contrast thereto, when other circuitry or materials are within the vicinity of the antenna, the emitted radio waves would be absorbed, at least in part, rather than distributed to the potential receiver, thereby leading to decreased performance.

Accordingly, an antenna that is capable of efficiently handling wireless communication on two or more frequency bands and that has a simple and compact design is desirable.

SUMMARY

The invention is defined by an antenna according to claim 1 and by a system for wireless communication including an antenna according to claim 13. Further embodiments are defined by the dependent claims. Additional features and advantages of the concepts disclosed herein are set forth in the description which follows, and in part will be obvious from the description, or may be learned by practice of the described technologies. The features and advantages of the concepts may be realized and obtained by means of the instruments and combinations particularly pointed out in the appended claims. These and other features of the described technologies will become more fully apparent from the following description and appended claims, or may be learned by the practice of the disclosed concepts as set forth herein.

In embodiments, an antenna may include a first planar conductor, which is adapted to resonate at frequencies of a first frequency range, as well as a second planar conductor, which is adapted to resonate at frequencies of a second frequency range that spans lower frequencies than the first frequency range.

In embodiments, the antenna may include a coil which is conductively coupled to the planar conductors. The coil may be configured to act as a capacitor for the frequencies of the first frequency range and the coil may be configured to act as an inductor for the frequencies of the second frequency range.

In embodiments, the coil may be the only discrete electrical component in a grounding leg of the antenna which couples the antenna to ground. The coil may further be one of a wire-wound type, a planar film type and a multilayer film type, and the distance between neighboring windings of the coil may be configured such that the coil acts as the capacitor for the frequencies of the first frequency range and as the inductor for the frequencies of the second frequency range.

In embodiments, the coil is configured to match a characteristic impedance for each of the frequencies of the first and the second frequency ranges. The impedance may preferably have a value of 50Ω.

In embodiments, the antenna may include a feeding leg which couples the antenna to an electric circuit.

In embodiments, a width of a conductive track of the first planar conductor may be at least 20%, preferably at least 30%, more preferably at least 40%, and even more preferably at least 50% greater than a width of a conductive track of the second planar conductor.

In embodiments, the antenna may further include a third planar conductor, which is adapted to resonate at frequencies of the first frequency range and a fourth planar conductor, which is adapted to resonate at frequencies of the second frequency range.

In embodiments, a width of a conductive track of the third planar conductor may be substantially the same as a width of a conductive track of the first planar conductor.

In embodiments, a width of a conductive track of the fourth planar conductor may be substantially the same as a width of a conductive track of the second planar conductor.

In embodiments, the length of a conductive track of the first and the third planar conductors may be at least 30%, preferably at least 40% and more preferably at least 50% smaller than the length of a conductive track of the second and the fourth planar conductors.

In embodiments, the second planar conductor may include a first portion and a second portion conductively coupled to the first portion and the first portion may extend in a first direction and the second portion may extend in a second direction. Further, the first and the second portion may extend in directions that are substantially perpendicular to each other. The first and the second direction may also be arranged at any other angle to each other. For example, the first and second directions may be arranged at an angle between 0 to 45 degrees, between 45 to 90 degrees, between 90 to 180 degrees or between 180 to 359 degrees with respect to each other.

In embodiments, the fourth planar conductor may include a first portion and a second portion conductively coupled to the first portion and the first portion may extend in the first direction and the second portion may extend in the second direction.

In embodiments, each of the first planar conductor, the second planar conductor, the third planar conductor and the fourth planar conductor may at least have one of a rectangular shape or an L-shape.

In embodiments, a planar conductor which is adapted to resonate at frequencies of the first frequency range and a planar conductor which is adapted to resonate at frequencies of the second frequency range may be separate from each other. Further, a planar conductor which is adapted to resonate at frequencies of the first frequency range and a planar conductor which is adapted to resonate at frequencies of the second frequency range may be connected to each other. Even further, the first and the second planar conductors may be separate from each other and the third and the fourth planar conductors may be connected to each other.

In embodiments, the length of the first and the second planar conductors may be at least 1%, preferably at least 10%, more preferably at least 20% and even more preferably at least 30% smaller than the length of the third and the fourth planar conductors.

In embodiments, the antenna may include a substrate and at least one of the planar conductors may be arranged on a first surface of the substrate. Further, at least another one of the planar conductors may be arranged on a second surface of the substrate that is opposite to the first surface.

In embodiments, the grounding leg and the coil may be arranged on a first surface of the substrate.

In embodiments, the feeding leg may be arranged on a second surface of the substrate.

In embodiments, the substrate may preferably be at least a portion of at least one of a printed circuit board or a ceramic sheet substrate.

In embodiments, a plurality of vias may conductively couple the first planar conductor to the third planar conductor and a plurality of vias may conductively couple the second planar conductor to the fourth planar conductor.

In embodiments, a distance between neighbouring vias of the plurality of vias that conductively couple the first planar conductor to the third planar conductor may be at least 40%, preferably at least 50%, more preferably at least 60% and even more preferably at least 70% smaller than a distance between neighbouring vias of the plurality of vias that conductively couple the second planar conductor to the fourth planar conductor.

In embodiments, the antenna may include one or more inner layers between a first surface and a second surface of the substrate. Further, each of the inner layers may include one or more planar conductors that may each be coupled to one or more planar conductors of the other inner layers and/or of the surfaces of the substrate, respectively.

In embodiments, the first frequency range may span at least frequencies between 5180 Megahertz to 5825 Megahertz, preferably at least between 4000 Megahertz to 6000 Megahertz and more preferably at least between 3000 Megahertz to 7000 Megahertz. Further, the second frequency range may span at least frequencies between 2412 Megahertz to 2472 Megahertz, preferably between at least 1500 Megahertz to 3500 Megahertz and more preferably between at least 900 Megahertz to 4500 Megahertz.

In embodiments, the antenna may be configured to be used for wireless communication according to at least one of the following standards for wireless communication: the IEEE 802.11 standards family, ZigBee and BLUETOOTH.

In embodiments, a system for wireless communication may be provided that may include the antenna of any of the embodiments of the present disclosure. The system may further include a printed circuit board and the antenna may be arranged at a corner of the printed circuit board.

In embodiments, a distal end of the second portions of the second and/or the fourth planar conductors may be arranged in a distance from a neighbouring edge of the printed circuit board in the first and/or the second direction.

In embodiments, a distal end of the first and/or the third planar conductors may be arranged in a distance from a neighbouring edge of the printed circuit board in the first and/or the second direction.

In embodiments, a distance between a neighbouring edge of the printed circuit board and the respective distal end may be at least 10%, preferably at least 20%, more preferably at least 30% and even more preferably at least 40% of the length of the second portions.

In embodiments, the distance between the neighbouring edge of the printed circuit board and the distal ends of the second portions may stretch along a section of the second portions extending from the distal ends in the directions opposite to the first and/or the second directions.

In embodiments, the distance between the neighbouring edge of the printed circuit board and the distal ends of the first and/or the third planar conductors may stretch along a section of the first and/or the third planar conductors extending from the distal ends in the direction opposite to the first and/or the second directions.

In embodiments, the length of the sections may be at least 20%, preferably at least 40%, more preferably at least 50% and even more preferably at least 60% of the length of the second portions.

In embodiments, a distance between the sections and the neighbouring edges of the printed circuit board may be created by a cutout of the printed circuit board.

In embodiments, the antenna may be located at a corner of a housing of the system.

In embodiments, the housing of the system may preferably have a substantially rectangular cross-section and the antenna may be located at a corner point of the cross-section of the housing of the system.

In embodiments, the distance between the corner point of the cross-section of the housing of the system and the point of the antenna at which the first and the second portions of the second planar conductor abut each other may be less than 30%, preferably less than 20%, more preferably less than 10% and even more preferably less than 3% of a length of any side of the cross-section of the housing of the system.

In embodiments, the system may be any one of a cordless telephone or a cellular telephone.

The preceding summary is provided for purposes of summarizing some embodiments, to provide a basic understanding of aspects of the subject matter described herein. Accordingly, the above-described features are merely examples and should not be construed to narrow the scope of the subject matter described herein in any way. Moreover, the above and/or proceeding embodiments may be combined in any suitable combination to provide further embodiments. Other features, aspects, and advantages of the subject matter described herein will become apparent from the following Detailed Description, Figures, and Claims.

BRIEF DESCRIPTION OF THE DRAWINGS

In order to best describe the manner in which the above-described embodiments are implemented, as well as define other advantages and features of the disclosure, a more particular description is provided below and is illustrated in the appended drawings in which like numerals denote like elements. Understanding that these drawings depict only exemplary embodiments of the invention and are not therefore to be considered to be limiting in scope, the examples will be described and explained with additional specificity and detail through the use of the accompanying drawings in which.

DETAILED DESCRIPTION

Figure 1:
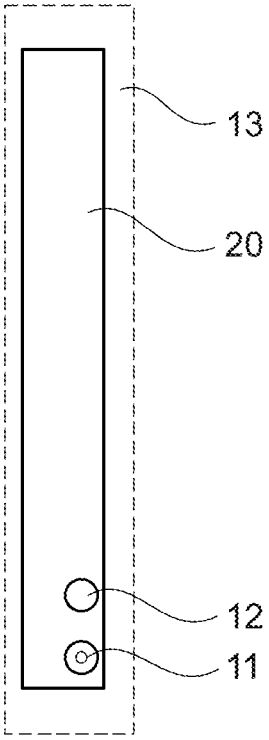
FIG. 1 schematically illustrates an antenna that may be used for wireless communication.

Various embodiments of the disclosed methods and arrangements are discussed in detail below. While specific implementations are discussed, it should be understood that this is done for illustration purposes only. A person skilled in the relevant art will recognize that other components, configurations, and steps may be used without parting from the scope of the disclosure.

The present disclosure may be better understood in view of the following explanations:

As used herein, the term radiation element may include an element that is formed from an electrically conductive material and which resonates at specific frequencies based on its characteristics, such as its physical dimensions (e.g. length, width, breadth) and its electrical characteristics (e.g. dielectric constant of the substrate). This frequency or range of frequencies can thus be referred to as the resonant frequency. When tuning a radiation element for use in wireless communication, the respective characteristics of the radiation element may thus be chosen such that the resonant frequencies match those of the frequency band at which transmission and reception of wireless signals is desired. Optimal performance may result from such tuning. In the context of the description of the present invention, the terms radiation element and resonance element may therefore refer to the same element. Similarly, the terms radiation element and conductor and/or planar conductor may refer to the same element.

As used herein, the term frequency band may refer to an interval in the frequency domain that is delimited by a lower frequency and an upper frequency. The term may further refer to a radio band, which may be defined according to standards of wireless communication or according to regulations which specify commercially usable frequencies. An antenna that is tuned for operation on a specific frequency band may thus respond to frequencies of the frequency band. Each frequency band may be characterized by a certain bandwidth, which is the difference between the upper and lower delimiting frequencies in a continuous band of frequencies, and a frequency band may further include one or more communication channels for communication of signals.

As used herein, the term feeding leg may refer to a conductive connection with which an antenna may be coupled to other circuitry, such as circuitry of a device into which the antenna may be incorporated.

As used herein, the term grounding leg may refer to a conductive connection with which an antenna may be coupled to ground, such as a ground plane of a device into which the antenna may be incorporated.

As used herein, the term different may describe a situation where one element is larger or smaller by any amount with respect to another element. For example, when one element is described to have a different width or a different length than another element, this includes the option that the element may have a larger width or length as well as the option that the element may have a smaller width or length than the other element. Thus, in the context of this disclosure, the term different may serve the purpose to describe options where one element may be larger or smaller with respect to another element.

As used herein, the term substantially the same as may refer to one element being identical to, i.e. the same as, another element; it may also refer to one element being relatively similar to the other element, such that the two elements do not differ largely when compared to each other. For example, is one direction is substantially the same as another direction, the two directions may be identical, or they may slightly vary from each other, i.e. by an angle of few degrees. Similarly, a length that is substantially the same as another length may refer to both lengths being of identical magnitude, or that one length differs only by a low percentage, such as by a few percent of the magnitude of its length, with respect to another length.

As used herein, the terms coupled to or connected with may both refer to one element being conductively attached to another element. These terms may be used interchangeably in the context of this disclosure.

As used herein, the term communication resources may refer to hardware and/or firmware for electronic information transfer. Wireless communication resources may include hardware to transmit and receive signals by radio and may include various protocol implementations e.g. the 802.11 standard described in the Institute of Electronics Engineers (IEEE) and BLUETOOTH™ from the Bluetooth Special Interest Group of Kirkland Wash. Wired communication resources may include; Universal Serial Bus (USB); High-Definition Multimedia Interface (HDMI) or other protocol implementations. The apparatus may include communication resources for communication with a peripheral device.

As used herein, the term network or computer network may refer to a system for electronic information transfer. The network may include one or more networks of any type, which may include: a Public Land Mobile Network (PLMN); a telephone network (e.g. a Public Switched Telephone Network (PSTN) and/or a wireless network); a local area network (LAN); a metropolitan area network (MAN); a wide area network (WAN); an Internet Protocol Multimedia Subsystem (IMS) network; a private network; the Internet; an intranet.

Referring to FIG. 1, an antenna that may be used for wireless communication on a single frequency band is provided. The illustrated antenna is based on a typical antenna layout as it was used in the prior art. The antenna may include a radiation element 20 having a substantially rectangular shape. The radiation element 20 is formed by a planar conductor that is made from an electrically conductive material. Example materials may be any one of copper, silver, gold, platinum, aluminium and other metals, or any combination thereof, or metal alloys including any such metals. The radiation element, i.e. the planar conductor 20, may be provided with a feeding pin 12 and with a grounding pin 11. The feeding pin 12 enables the antenna to be coupled to any circuitry of a device that may be used for wireless communication. Accordingly, signals that may have to be transmitted from a wireless device to a receiver can be supplied from the device to the antenna by means of the feeding pin 12. The grounding pin 11 enables the antenna to be coupled to ground, such as a ground plane of the wireless device. The antenna further includes a substrate 13 on which the planar conductor 20 is arranged. Typically, substrate 13 may be a printed circuit board, PCB, on which other circuitry of the wireless device may also be provided. Each of the feeding pin 12 and the grounding pin 11 are connected to a respective leg of the antenna which couple to the circuitry of the wireless device on the PCB 13. In FIG. 1, these legs cannot be seen, because they extend from beneath the planar conductor 20 towards the PCB 13. Because of the shape of the antenna, which therefore resembles an F lying on its side, it may be referred to as inverted F antenna.

The characteristics of the antenna regarding its layout, such as length of the radiation element 20, as well as distance of the grounding and feeding point from each other and with respect to the length of the radiation element 20 determine a frequency range at which the antenna resonates. In order to tune the antenna to receive signals, relevant characteristics are thus its physical dimensions (e.g. length, width, breadth) and its electrical characteristics (e.g. dielectric constant of the substrate). For example, when the antenna includes a longer planar conductor 20, the resonant frequency of the antenna is generally decreased, because lower frequencies have a longer wavelength than higher frequencies. Similarly, when the antenna includes a shorter planar conductor 20, the resonant frequency of the antenna is generally increased, because higher frequencies have a shorter wavelength than lower frequencies. The speed of the electrical wave in the material of the planar conductor 20 is another criterion which influences the resonant frequency of the antenna. For this reason, choice of the specific material from which the planar conductor 20 is made also influences the resonant frequency of the antenna. It will be appreciated that also the choice of the material of any carrier substrate will influence the speed of the electrical wave. However, because planar conductor 20 is not arranged in direct contact with the substrate 13, and rather extends in the air above (as will be described in the following sections), the speed of the electrical wave is not influenced by the choice of the material of substrate 13.

Because planar conductor 20 has a relatively wide track, a plurality of different lengths is formed in the planar conductor 20. For example, one length extends from a corner of one distal end of the relatively wide track of the planar conductor 20 to a diagonally opposite corner on the opposite distal end of the relatively wide track of the planar conductor 20. Another length extends along the edge of the planar conductor 20, i.e. from the corner of the one distal end of the planar conductor 20 to the opposite corner on the opposite distal end of the planar conductor 20. The first of these lengths, i.e. the diagonal length, is longer than the second of these lengths, i.e. the length of the edge of planar conductor 20. A plurality of further different lengths in between these two lengths also exist. Accordingly, as the length of the radiation element 20 is a characteristic which influences the resonant frequency and because a plurality of different lengths exists in a radiation element 20 having a planar conductor with a relatively wide track, such a radiation element 20 is suitable for receiving and transmitting radio signals at a range of frequencies rather than just one frequency. Hence, a larger width of planar conductor 20 may generally increases the bandwidth at which the antenna is capable of receiving and transmitting radio signals. This may be desirable when the antenna is to be used for wireless communication at frequencies of a broad range, i.e. a large bandwidth.

However, while such an antenna may be suitable for reception of radio signals of a range of contiguous frequencies, modern wireless communication methods may require communication among a number of different frequency bands that do not consist of contiguous frequencies. For example, one frequency band may utilize frequencies of a range from 5180 Megahertz to 5825 Megahertz, while another frequency band may utilize frequencies of a range from 2412 Megahertz to 2472 Megahertz. If the antenna as illustrated in FIG. 1 was to be used for wireless communication on both of the frequency bands, its performance would not achieve the required levels due to the large frequency difference, and thus large difference in wavelengths of the frequencies. For this reason, two antennas have been used in wireless devices, each of the antennas being configured, i.e. tuned, for reception and transmission of radio signals at one of the respective frequency bands. However, this has the disadvantages of increased cost for producing both antennas, as well as increased space requirements in the housing of the device into which the antennas are incorporated.

The planar conductor 20 of an inverted F antenna in accordance with FIG. 1 extends parallel to the substrate 13, but does not touch the substrate and is rather arranged in a distance to the substrate. For this reason, the antenna requires additional space within a housing of the wireless device into which it is incorporated.

Figure 2:
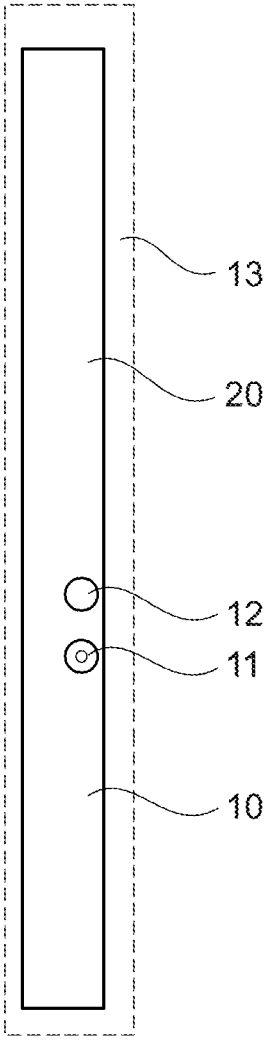
FIG. 2 schematically illustrates an antenna that may be used for wireless communication on at least two different frequency bands.

Referring to FIG. 2, in embodiments of this disclosure, an antenna that may be used for wireless communication on at least two different frequency bands may be provided. The antenna includes components as described with respect to FIG. 1, i.e. planar conductor 20, feeding pin 12 that is connected to a feeding leg, grounding pin 11 that is connected to a grounding leg and a substrate 13, such as a PCB. In addition, the antenna includes a second planar conductor 10. The planar conductor 10 may have different characteristics than the planar conductor 20. For example, planar conductor 10 may have a different length than planar conductor 20. When planar conductor 10 has a shorter length than planar conductor 20, planar conductor 10 may have a higher resonant frequency than planar conductor 20, thus making it suitable for reception and transmission of radio signals on a frequency band which spans higher frequencies, respectively. Planar conductor 10 may also have a different width than planar conductor 20. For example, when planar conductor 10 has a wider width than planar conductor 20, it may be suitable for reception and transmission of radio signals on the wider frequency band, i.e. a frequency band having a larger bandwidth.

Planar conductor 10 may be connected to planar conductor 20 and may extend from the feeding pin 12 in a direction that is opposite to the direction in which planar conductor 20 extends from the feeding pin 12. However, the direction in which planar conductor 10 extends is not limited to the opposite direction, and planar conductor 10 could also extend in any other direction. For example, it may be arranged at an angle between 0 to 45 degrees, between 45 to 90 degrees, between 90 to 180 degrees or between 180 to 359 degrees with respect to the direction in which the planar conductor 20 extends from feeding pin 12.

In embodiments, only one feeding leg and one grounding leg couple the two planar conductors, i.e. both radiation elements, to the circuitry of the wireless device on PCB 13. For optimal performance it is necessary that the characteristic impedance of both radiation elements is matching the typical characteristic impedance used in wireless communications, which is 50 Ohm. With a single leg connecting both radiation elements, this may be achieved by use of additional impedance matching circuitry that may be switched from one configuration to another configuration depending on which radiation element is to be used at a given time. However, this not only limits the antenna to operation of only one of both radiation elements at a time, but also requires use of additional circuitry. Any additional electric component that is included in an electric circuit leads to additional losses, which is not desirable. Further, additional circuitry and electric components lead to further spatial requirements in the housing of the wireless device into which the antenna is incorporated, as well as to increased production cost.

In embodiments of this disclosure, the planar conductors 10 and/or 20 may be made from copper that has a gold plating. The gold plating may be provided in order to reduce oxidation which may otherwise occur over time. Preventing oxidation is desirable, because it would decrease the performance of the antenna. The skin effect leads to the planar conductor transmitting any electric signals having a relatively high frequency especially on the outside portions of the planar conductor. For this reason, providing gold plating, or plating with another metal that is suitable to prevent oxidation, may be advantageous and may increase the performance of the antenna.

Figure 3:
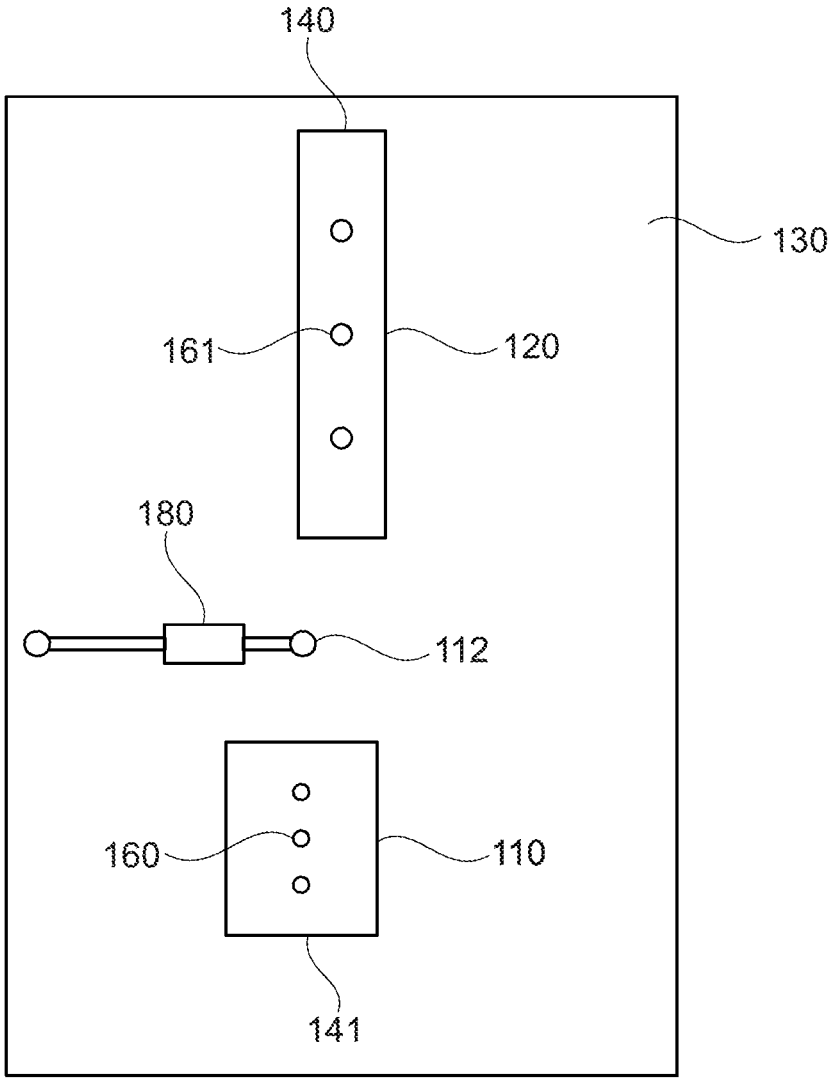
FIG. 3 schematically illustrates a first layer of an antenna including two radiation elements that may be used for wireless communication.
Figure 4:
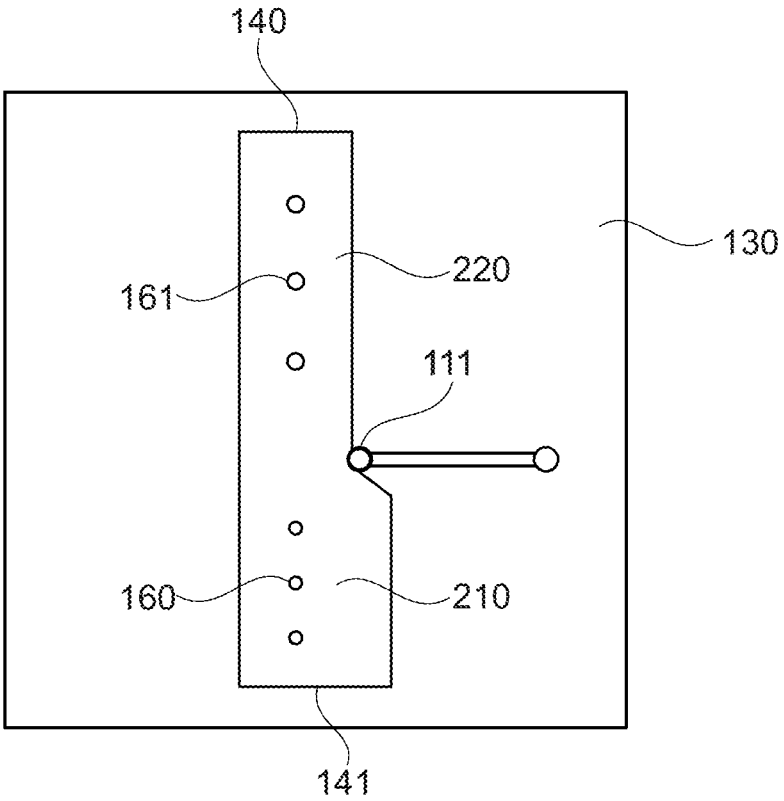
FIG. 4 schematically illustrates a second layer of an antenna including two radiation elements that may be used for wireless communication.

Referring to FIGS. 3 and 4, in embodiments of this disclosure, an antenna having two layers and including two radiation elements on each of the layers may be provided. The antenna may be used for wireless communication on at least two different and non-contiguous radio bands. In FIG. 3, the antenna is illustrated as seen from one side. In FIG. 4, the antenna is illustrated as seen from the other side, i.e. the opposite side.

Referring to FIG. 3, the antenna may include two radiation elements, i.e. planar conductors, 110 and 120. Planar conductor 110 may be a first planar conductor that has a width 141 that enables planar conductor 110 to be suitable for transmission and reception of radio signals at a bandwidth of frequencies of a first frequency range. Further, planar conductor 110 has a length that enables it to be suitable for transmission and reception of radio signals at the first frequency range.

Planar conductor 120 may be a second planar conductor that has a width 140 that enables planar conductor 120 to be suitable for transmission and reception of radio signals at a bandwidth of frequencies of a second frequency range. Further, planar conductor 120 has a length that enables it to be suitable for transmission and reception of radio signals at the second frequency range.

For example, the width 140 may be less than the width 141. Therefore, the second planar conductor may be suitable for transmission and reception of radio signals at a smaller bandwidth of frequencies than the first planar conductor. However, the width of each planar conductor can be chosen in accordance with the requirements of the antenna and can thus be selected to be the same or different for each planar conductor. Further, in embodiments of the disclosure, the first planar conductor may have a shorter length than the second planar conductor. Therefore, the second planar conductor may be suitable for transmission and reception of radio signals of a second frequency range that spans lower frequencies than the first frequency range. However, the length of each planar conductor can be chosen in accordance with the requirements of the antenna and can thus be selected to be the same or different for each planar conductor. In embodiments of this disclosure, the first frequency range may span at least frequencies between 5180 Megahertz to 5825 Megahertz, preferably at least between 4000 Megahertz to 6000 Megahertz and more preferably at least between 3000 Megahertz to 7000 Megahertz. Further, the second frequency range may span at least frequencies between 2412 Megahertz to 2472 Megahertz, preferably between at least 1500 Megahertz to 3500 Megahertz and more preferably between at least 900 Megahertz to 4500 Megahertz. Other exemplary frequency ranges may span any one of 225 Megahertz to 400 Megahertz or 900 Megahertz to 1800 Megahertz for the first frequency range and/or the second frequency range, respectively. By tuning the radiation elements of an antenna in accordance with this disclosure for different frequency bands, the antenna may be configured to be used for wireless communication according to at least one of the following standards for wireless communication: the IEEE 802.11 standards family, ZigBee and BLUETOOTH. Based on these or any other standards, the frequency ranges for which the planar conductors are tuned can be determined.

In embodiments of this disclosure, the first and second planar conductors may be connected to each other, or the first and second planar conductors may be separate from each other, as is illustrated in FIG. 3. Both of the first and second planar conductors may be provided directly on a surface of substrate 130. Accordingly, in contrast to embodiments in accordance with FIGS. 1 and 2, the planar conductors are not arranged in a distance to the substrate 130, i.e. the planar conductors are not arranged at a certain height above the respective surface of the substrate 130. However, embodiments in accordance with FIGS. 3 and 4 still provide for the possibility of tuning the antenna that are similar to an inverted F antenna, because a grounding leg that is connected to grounding pin 112 may be arranged on the surface of substrate 130 on which the first and second planar conductors are arranged and because a feeding leg that is connected to feeding pin 111 may be arranged on the opposite surface of substrate 130 on which a third and a fourth planar conductor may be arranged. This layout combines the possibility to tune the antenna similar to a conventional inverted F antenna, while preserving the space which conventional inverted F antenna would additionally require in a housing of a wireless device into which the antenna is incorporated.

Substrate 130 may be a printed circuit board, or a portion of a printed circuit board of the wireless device into which the antenna is incorporated. Substrate 130 may also be a ceramic sheet substrate. Any other suitable material may also be used, in order to enable the antenna to be suitable for transmission and reception of radio signals of the respective frequency range. It will be appreciated that the speed of the electrical wave in the radiation elements being arranged in direct contact with the surfaces of substrate 130 is influenced by the choice of material of substrate 130. In contrast to the typical antenna layout as described with respect to FIGS. 1 and 2, this aspect should thus be taken into consideration for tuning of the antenna according to such an antenna layout.

A grounding leg that is connected to grounding pin 112 may be arranged on the surface of substrate 130 on which the first and second planar conductors are arranged. The grounding leg may include a coil 180. Coil 180 may thus be conductively coupled to the planar conductors by means of the grounding leg and grounding pin 111. Coil 180 represents an inductor. An inductor may increase the effective electrical length of a conductor, while a capacitor may decrease the effective electrical length of a conductor. Further, an inductor may have a self resonance at a self resonant frequency above which the inductor acts as a capacitor and below which it acts as an inductor. Accordingly, coil 180 has the effect as if the grounding leg is shorter for high frequencies, i.e. frequencies above the self resonant frequency of coil 180, and as if the grounding leg is longer for low frequencies, i.e. for frequencies below the self resonant frequency of coil 180.

For these reasons, coil 180 may act as a capacitor for the frequencies of the first frequency range, i.e. the higher frequencies, while it may act as an inductor for the frequencies of the second frequency range, i.e. the lower frequencies, respectively. This allows for matching the characteristic impedance of the antenna for each of the first and second planar conductors by using a single grounding leg including coil 180, because coil 180 acts for each of the planar conductors in such a manner that the characteristic impedance may be the same, for example 50 Ohm. Therefore, the coil 180 is the only discrete electrical component in a grounding leg of the antenna 100 which couples the antenna 100 to ground. Accordingly, performance of the antenna can be optimized while the total number of electrical components that are necessary to implement the present antenna layout in a wireless device is reduced to only one coil. Losses due to electrical components are thus minimized and efficiency of the antenna can be advantageously increased. Further, production cost is minimized due to fewer electrical components being required when compared to embodiments that are in accordance with FIGS. 1 and 2.

It may be particularly desirable to utilize the effect of coil 180 acting as both a capacitor and inductor for different frequency ranges when the difference between the frequency ranges is sufficiently large. For example, it may be desirable for optimal performance that the difference of the magnitude between frequencies of the first frequency range is at least 50%, or preferably at least 75%, more preferably at least 100% or even more preferably at least 200% of the magnitude of frequencies of the second frequency range. For example, when frequencies of the second frequency range differ from frequencies of the first frequency range by a factor of two, the difference between the frequency ranges may be sufficiently large to ensure that the frequencies of the first frequency range are well above the resonant frequency of coil 180, as well as that the frequencies of the second frequency range are well below the resonant frequency of coil 180. Therefore, it may be desirable to tune the different radiation elements of an antenna according to the embodiments of this disclosure for reception and transmission of radio signals on frequency bands that differ by a magnitude as described. Such tuning will lead to increased performance and maximizes the benefits of the aspects of this disclosure, thereby resulting in a simple and compact antenna layout where only one discrete electrical component is required to couple the antenna to the circuitry of any device into which the antenna may be incorporated and where the antenna is still optimized for transmission and reception of radio signals on at least two different frequency bands.

In embodiments of this disclosure, coil 180 may be one of a wire-wound type, a planar film type and a multilayer film type. However, coil 180 may be of any other type that is suitable to achieve the above-described characteristics. Such suitability may be achieved by the coil being configured to have a distance between neighbouring ones of its windings such that the coil acts as a capacitor for the frequencies of the first frequency range and as the inductor for the frequencies of the second frequency range, as will be apparent to those skilled in the art having the benefit of the present disclosure.

Referring to FIG. 4, the antenna may include two radiation elements, i.e. planar conductors, 210 and 220. Planar conductor 210 may be a third planar conductor that has a width 141 that enables planar conductor 210 to be suitable for transmission and reception of radio signals at a bandwidth of frequencies of a first frequency range. Further, planar conductor 210 has a length that enables it to be suitable for transmission and reception of radio signals at the first frequency range.

Planar conductor 220 may be a fourth planar conductor that has a width 140 that enables planar conductor 220 to be suitable for transmission and reception of radio signals at a bandwidth of frequencies of a second frequency range. Further, planar conductor 220 has a length that enables it to be suitable for transmission and reception of radio signals at the second frequency range.

For example, the width 140 and the width 141 of the third and fourth planar conductor may be the same or similar to the width 140 and the width 141 of the first and second planar conductor, respectively. Therefore, the fourth planar conductor may be suitable for transmission and reception of radio signals at a smaller bandwidth of frequencies than the third planar conductor. However, the width of each planar conductor can be chosen in accordance with the requirements of the antenna and can thus be selected to be the same or different for each planar conductor. Further, in embodiments of the disclosure, the third planar conductor may have a shorter length than the fourth planar conductor. Therefore, the fourth planar conductor may be suitable for transmission and reception of radio signals of a second frequency range that spans lower frequencies than the first frequency range. However, the length of each planar conductor can be chosen in accordance with the requirements of the antenna and can thus be selected to be the same or different for each planar conductor.

Furthermore, it is possible to select the width and the length of any one of the planar conductors on each side of the antenna such that they are the same or different with respect to any one of the planar conductors on each respective side. For example, the width and the length of the first planar conductor may be the same as the width of the third planar conductor, or the length of the first planar conductor may be different from the width of the third planar conductor.

In embodiments of this disclosure, the third and fourth planar conductors may be connected to each other, as is illustrated in FIG. 4, or the third and fourth planar conductors may be separate from each other, similar to the first and second planar conductors as illustrated in FIG. 3. Both of the third and fourth planar conductors may be provided directly on the surface of substrate 130 that is opposite to the surface on which the first and second planar conductors are arranged. When the planar conductors are connected to each other, their length may be increased when compared to a configuration where they are separate from each other. As such, the different lengths may be utilized to tune the respective radiation elements of the antenna for transmission and reception of radio signals at (slightly) different frequency bands. This aspect may therefore also be desirable when the bandwidth of the frequencies for which the radiation elements of the antenna are tuned must be increased.

Furthermore, while it has been described that the antenna in accordance with FIGS. 3 and 4 comprises two planar conductors on each surface of substrate 130, any other number of planar conductors could also be used. For example, only one or more than two planar conductors could be used, and the total number of planar conductors on each of the surfaces of substrate 130 may also be different, respectively.

A feeding leg that is connected to feeding pin 111 may be arranged on the surface of substrate 130 on which the third and fourth planar conductors are arranged. The feeding leg does not include any (additional) electrical components. Hence, as has already been described, coil 180 that may be included in the grounding leg may be the only discrete electrical component that is necessary to incorporate the antenna into a wireless device.

Any electrical components or elements, i.e. material, that is in the vicinity of the antenna may reflect and absorb radio waves that are emitted by the planar conductors of the antenna. It is, however, desirable when a device into which the antenna is incorporated may transmit radio signals to and receive radio signals from transmitters and/or receivers that are positioned in a distance at any direction with respect to the device. Accordingly, by providing planar conductors on each of the two sides of substrate 130, the number of directions into which the antenna may efficiently transmit radio signals and from which the antenna may efficiently receive radio signals is increased, i.e. maximized. In an example where planar conductors are only provided on one side of the substrate 130, the substrate 130 would have the effect of absorbing, at least in part, the radio signals that are transmitted into a direction that is blocked by the substrate 130. Thus, by providing planar conductors on each side, the directions that can be efficiently covered by the antenna are advantageously increased.

Figure 7:
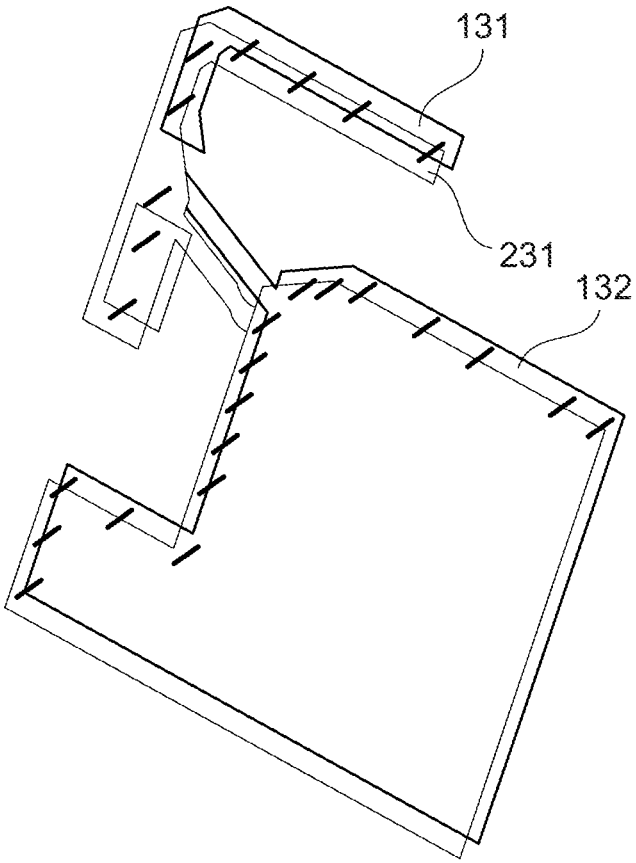
FIG. 7 schematically illustrates a perspective view of the outlines of two surfaces of a system including two layers of an antenna, each layer including two radiation elements that may be used for wireless communication.

The planar conductors on each surface of substrate 130 may be coupled to each other by means of vias 160, 161. A via is an electrical connection between layers in a physical electronic circuit that goes through the plane of one or more adjacent layers. A via may also be referred to as a vertical interconnect access, and/or as a through-connection. The vias 160 and 161 vertically extended through the substrate 130 and are made of electrically conductive material. For example, first planar conductor 110 on one surface of substrate 130 may be coupled to third planar conductor 210 that is arranged on the other surface of substrate 130 by means of vias 160. Similarly, second planar conductor 120 on one surface of substrate 130 may be coupled to fourth planar conductor 220 that is arranged on the other surface of substrate 130 by means of vias 161. Accordingly, vias 160 and vias 161 enable each of the grounding leg and the feeding leg to be conductively coupled to each of the planar conductors on each side of substrate 130, even when the grounding leg and the feeding leg are provided on different sides of substrate 130. As has been previously described, the length of the conductors has a direct influence on the resonant frequency of the conductors. The point from which the length that determines the resonant frequency of the conductor is determined is the point at which the grounding leg and the feeding leg meet when seen from the perspective of the conductor. In embodiments that are in accordance FIGS. 3 and 4, the feeding leg and the grounding leg are arranged on opposite sides of substrate 130. For this reason, the length that is relevant to determine the resonant frequency of the planar conductors that are arranged on one of the two sides of substrate 130, respectively, is different for each of the two sides, because vias 160 and 161 have a length which increases the length of the conductive path that a signal which enters the antenna through the feeding leg must travel before it arrives at the planar conductor that is arranged on the opposite side, i.e. on the side on which the grounding leg is arranged, when compared to the length of the conductive path that a signal which enters the antenna through the feeding leg must travel before it arrives at the planar conductor that is arranged on the same side as the feeding leg. Accordingly, by providing planar conductors on each of the sides of substrate 130, while arranging the feeding leg on one side and while arranging the grounding leg on the other side, and by connecting the planar conductors by means of vias 160 and 161, the range of frequencies for which the antenna is suitable to transmit and receive radio signals is advantageously increased when compared to a single-sided arrangement of planar conductors, and/or when compared to an arrangement where both the grounding leg and the feeding leg are arranged on the same side of the substrate. Accordingly, the bandwidth of the antenna may be advantageously increased. This aspect can be seen in the perspective view as illustrated in FIG. 7, in which the vias and the planar conductors on two sides 131 and 231 of a substrate are illustrated.

The feeding leg and grounding leg may be directly coupled to the planar conductors that are arranged on the same side of the substrate as the feeding leg and grounding leg, or they may be coupled to the planar conductors that are arranged on the same side of the substrate by means of any one of the vias 160 and 161. For example, when the grounding leg is arranged on a first side of the substrate 130 and the planar conductor 110 is arranged on the first side of the substrate 130 as well, the grounding leg may either be conductively coupled to the planar conductor 110 directly, i.e. on the first side of the substrate 130, or the grounding leg may be conductively coupled to the planar conductor 110 by means of one or more vias that conductively couple the grounding leg to a component, such as another planar conductor 210, that is arranged on the opposite side of the substrate 130. Planar conductor 210 may then be conductively coupled to planar conductor 110 by means of one or more further, i.e. different vias, thus creating an electrically conductive connection between the grounding leg and planar conductor 110. Both of these options may apply for any conductor on any side of the substrate in accordance with embodiments of the present disclosure.

Each of the planar conductors on one side of the substrate 130 may be coupled to any of the planar conductors on the opposite side of the subject on 130 by means of one or more vias. Thus, vias 160 and 161 may include one or more vias, respectively. In the example as illustrated in FIG. 3, vias 160 and vias 161 each include three vias, respectively. However, this number may be changed without departing from the scope of this disclosure. Further, the distance between each one of vias 160 may be adapted in order to improve performance of the antenna. In this regard, a planar conductor that is suitable for transmission and reception of radio signals of a relatively higher frequency may preferably include vias with a relatively small the distance in between each one of the vias. For example, if planar conductor 110 is suitable for transmission and reception of radio signals of the first frequency range as described above, i.e. a frequency range including higher frequencies than the second frequency range, the distance between each one of vias 160 may be chosen to be smaller than the distance between each one of vias 161 of planar conductor 120 which is suitable for transmission and reception of radio signals of the second frequency range as described above, i.e. a frequency range including lower frequencies than the first frequency range. Generally, by using a larger number of vias, the planar conductors which are coupled to each other by means of these vias may resonate in an identical, or almost identical manner. Thus, in an example where planar conductor 110 is suitable for transmission and reception of radio signals of the first frequency range and where planar conductor 210 on the opposite side is also suitable for transmission and reception of radio signals of the first frequency range, both planar conductors are used as radiation elements for frequencies of the first frequency range. It may thus be desirable to enable both planar conductors to resonate synchronously. This may particularly apply even when the length of the planar conductor 110 slightly differs from the length of planar conductor 210. In such a configuration, the bandwidth for which the combined radiation elements can efficiently be used would be advantageously increased, while still enabling the radiation elements to resonate in a substantially synchronized manner, thereby resulting in a more efficient antenna.

Further, a larger number of vias may be beneficial for achieving synchronized resonance of the planar conductors. Optimal spacing between the vias is based, at least in part, on the wavelength of the frequencies for which the respective radiation element is tuned. Accordingly, providing radiation elements that are tuned for respectively higher frequencies with vias having a relatively smaller distance between neighbouring vias of the plurality of vias that conductively couple the radiation element to another radiation element that is also tuned for the respectively higher frequencies may be desirable. Accordingly, as is illustrated in FIG. 3, neighbouring ones of the vias of the plurality of vias 160 that conductively couple the first planar conductor 110 to the third planar conductor 210 may have a distance between each other that is smaller than the distance between neighboring vias of the plurality of vias 161 that conductively couple the second planar conductor 120 to the fourth planar conductor 220. In embodiments, the distance between neighboring vias of the plurality of vias 160 may be at least 40%, preferably at least 50%, more preferably at least 60% and even more preferably at least 70% smaller than the distance between neighboring vias of the plurality of vias 161.

Figure 5:
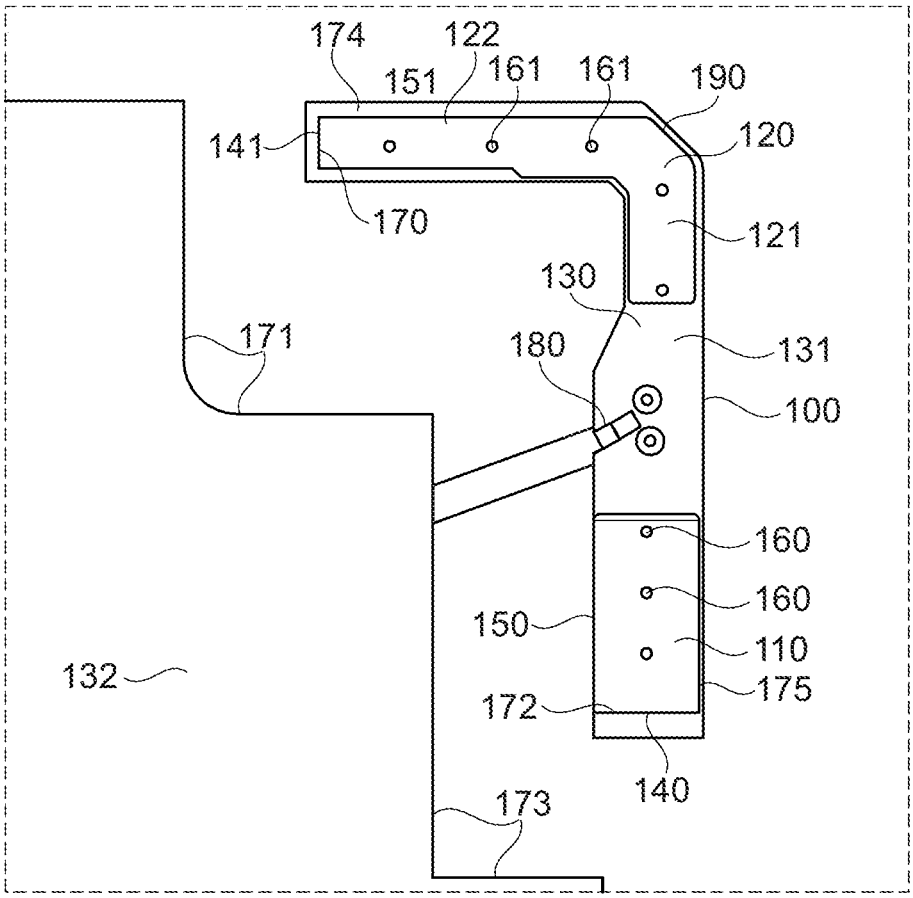
FIG. 5 schematically illustrates a view from a first side of a system including a first layer of an antenna including two radiation elements that may be used for wireless communication.
Figure 6:
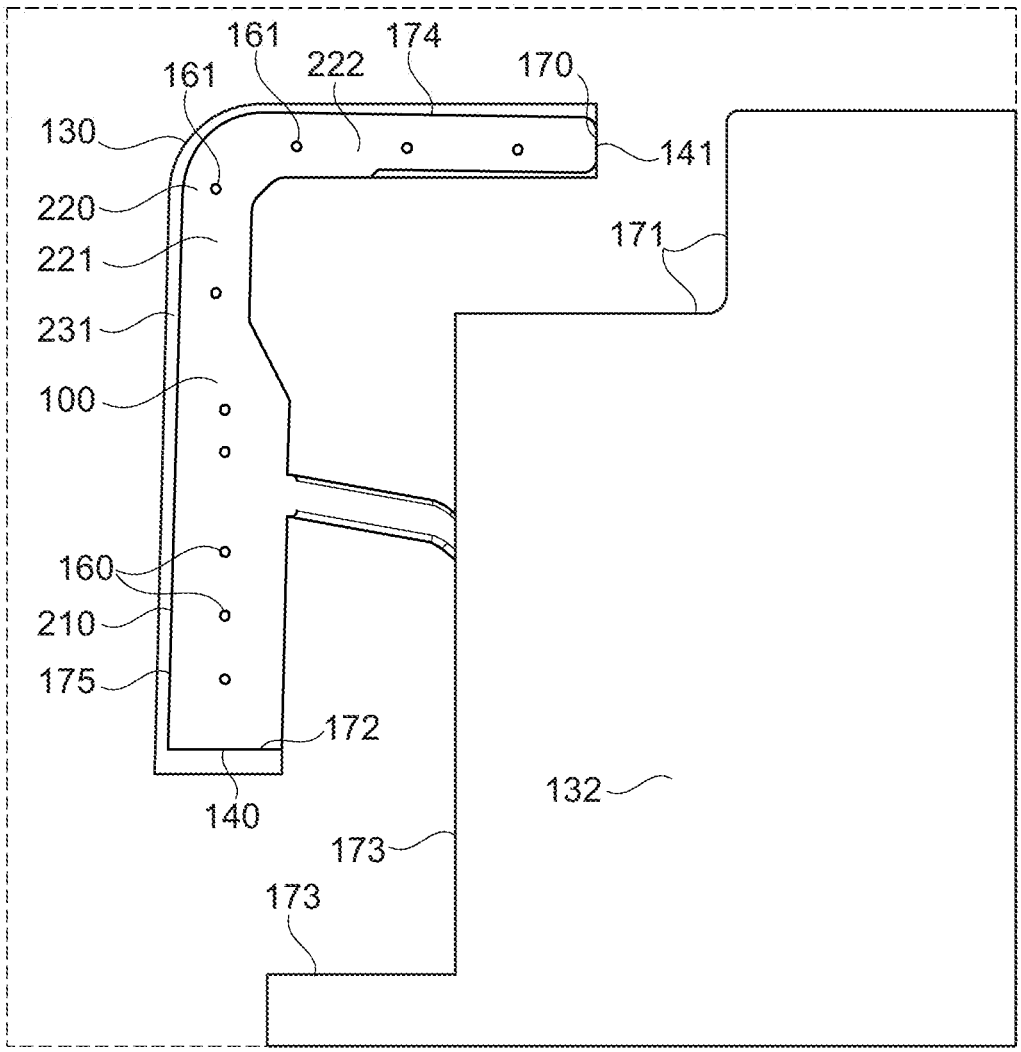
FIG. 6 schematically illustrates another view from a second side of a system including a second layer of an antenna including two radiation elements that may be used for wireless communication.

The elements in FIGS. 5 and 6 having like numerals as elements in FIGS. 3 and 4 may be the same as has been previously described. The description of such elements is not repeated in the following description, but aspects and features of embodiments in accordance with FIGS. 5 and 6 can be combined with any aspects and features of the embodiments as described with respect to FIGS. 3 and 4.

FIG. 5 schematically illustrates a view from a first side of a system including a first layer of an antenna including two radiation elements that may be used for wireless communication. In contrast to FIG. 3, the second planar conductor 120 is provided in an L-shape rather than in a rectangular shape. Hence, second planar conductor 120, according to all embodiments of the present disclosure, may also be configured to include a first portion 121 and a second portion 122 that is conductively coupled to the first portion 121. The first portion 121 may extend in a first direction and the second portion may extend in a second direction. The second direction may be substantially perpendicular to the first direction, as is illustrated in FIG. 5. This results in the second planar conductor 120 having an L-shape. However, the second direction may also be oriented at any other angle with respect to the first direction, thus enabling the planar conductor to have any shape. Accordingly, an antenna in accordance with the embodiments of this disclosure is not restricted to the shape or layout as illustrated in FIGS. 3 and 4 and may, for example, rather have the shape or layout as illustrated in FIGS. 5 and 6 or as has been described herewith. Similarly, planar conductor 120 may also include more than the first portion 121 and the second portion 122, such as three or more portions. Each of the three or more portions may be oriented at an individual direction with respect to the first and/or second directions. This allows that an antenna according to any aspects or embodiments of the present disclosure can be advantageously adapted to spatial requirements, such as to the shape of a housing of a device or a system into which the antenna may be incorporated.

As illustrated in FIGS. 5 and 6, antenna 100 may be incorporated into a system, for example into a wireless device or any other device that is to be used for wireless communication. Antenna 100 may be identical to any of the antennas and/or antenna layouts as have been previously described. Hence, the respective description is not repeated in the following description.

It will be appreciated that FIG. 5 illustrates a view on the system and antenna 100 facing a first side, i.e. surface 131 of substrate 130, while FIG. 6 illustrates another view on the same system and antenna 100 facing a second side, i.e. surface 231 of substrate 130. Accordingly, it will also be appreciated that the second direction into which portion 122 extends is in fact the same direction as the direction into which portion 222 extends, for example.

The system or device may include a printed circuit board, PCB, 132 on which further circuitry of the system may be arranged. For example, processing circuitry, such as a central processing unit, and other electrical components or chips may be arranged on PCB 132. The grounding legs and feeding legs as described with any of the embodiments of this disclosure may conductively couple the antenna 100 to such circuitry, such that the system may transmit and receive signals via means of antenna 100.

In embodiments of this disclosure, a distal end 170 of the second portions 122 and 222 of the second and/or the fourth planar conductors 120 and 220 may be arranged in a distance from a neighbouring edge 171 of the printed circuit board 132 in the first and/or the second direction. Therefore, a gap can be formed between the radiation elements of antenna 100 and the remaining circuitry of the system which is arranged on PCB 132. This gap, i.e. the space between the antenna 100 and the remaining circuitry of the system, is occupied by air. As a result, no elements or materials that may disadvantageously absorb or reflect, at least in part, the radio waves that are emitted from the radiation elements, such as planar conductor 120, therefore increasing performance of the antenna.

Similarly, with respect to any one of planar conductors 110 or 210, a distal end 172 of the first and/or the third planar conductors 110 and/or 210 may be arranged in a distance from a neighbouring edge 173 of the printed circuit board 132 in the first and/or the second direction. Accordingly, in embodiments of this disclosure, antenna 100 may be surrounded by a maximum amount of air for increased performance. In embodiments, the distance between any one of the neighbouring edges 171 and 173 of the printed circuit board 132 and any one of the respective distal ends 170 and 172 may be at least 10%, preferably at least 20%, more preferably at least 30% and even more preferably at least 40% of the length of the second portions 122 and 222. The larger the gap, the more air surrounds antenna 100, which may be desirable. It will be appreciated that a ground plane must, however, be within a certain distance from the radiation elements for the operation of the antenna. Thus, it may be desirable to maximize the amount of air surrounding the antenna, while positioning the radiation elements within a certain proximity to the ground plane to maintain mechanical support and durability of the structure.

The distance between the neighbouring edge 171 of the printed circuit board 132 and the distal ends 170 of the second portions 122 and 222 may further stretch along a section 174 of any one of the second portions 122 and 222 extending from the distal ends 170 in the directions opposite to the first and/or the second directions. Similarly, the distance between the neighbouring edge 173 of the printed circuit board 132 and the distal ends 172 of the first and/or the third planar conductors 110 and 210 stretches along a section 175 of the first and/or the third planar conductors 110 and 210 extending from the distal ends 172 in the direction opposite to the first and/or the second directions. By providing the antenna 100 in a system in such a configuration, the gap, i.e. the air-filled space, between the antenna 100 and the rest of the circuitry and PCB 132 of the system may be maintained along the length of the radiation elements of the antenna 100, thereby further increasing performance of antenna 100.

The length of any one of sections 174 and 175 may be at least 20%, preferably at least 40%, more preferably at least 50% and even more preferably at least 60% of the length of any one of the second portions 122 or 222.

Further, the distance between any one of the sections 174 and 175 and the respectively neighbouring edges 171 and 173 of the printed circuit board 132 may be created by a cutout of the printed circuit board (132). Thus, after performing the cutout, the antenna may be provided in a portion of a substrate 130 while the circuitry of the system may be provided on another portion of a substrate, such as PCB 132.

The antenna 100 may be located at a corner of a housing of the system. For example, the housing of the system may have a substantially rectangular cross-section, i.e. shape, and antenna 100 may be located at a corner point of the cross-section of the substantially rectangular housing of the system. By providing the antenna 100 at a corner of a housing of a system, such as a wireless device that has a housing having a substantially rectangular shape, it can be ensured that, other than the material of the housing of the system, no additional circuitry, components and/or material which may, at least in part, reflect and absorb radio waves that are emitted from the radiation elements, exist. Thereby, the amount of air surrounding the antenna in any direction may be increased, i.e. maximized, and the performance of antenna 100 within a system may be advantageously increased. Similarly, the directions into which antenna 100 may efficiently transmit or from which antenna 100 may efficiently receive radio signals may be increased, i.e. maximized, which may be desirable. It will be appreciated, that the above aspects also apply with respect to housings that have a different shape, such as a round, elliptical, triangular, pentagonal, hexagonal or any other such shape. For such other shapes the above aspects may result in the antenna to be positioned such that the distance between the radiation elements and the housing can still be maintained such that the antenna is advantageously surrounded by air.

For example, the corner point of the cross-section of the housing of the system and the point 190 of the antenna 100 at which the first and the second portions 121 and 122 of the second planar conductor 120 abut each other may be less than 30%, preferably less than 20%, more preferably less than 10% and even more preferably less than 3% of a length of any side of the cross-section of the housing of the system. Hence, the distance between the antenna 100 and the housing of the system itself may also be increased, in order to further increase performance of antenna 100 being arranged in a system.

The system may be any one of a cordless telephone or a cellular telephone or a smart device, all of which may be types of wireless devices. The system may also be a personal computer, laptop, notebook, PDA and any other type of handheld or stationary devices.

FIG. 6 schematically illustrates another view from a second side facing surface 231 of substrate 130 of the system, which includes a second layer of antenna 100 including two radiation elements that may be used for wireless communication. The aspects and embodiments that have been previously described with respect to any one of FIGS. 2, 3, 4 and 5 also apply to the elements that are illustrated in FIG. 6.

FIG. 7 schematically illustrates a perspective view of the outlines of two surfaces of a system including two layers of an antenna, each layer including two radiation elements that may be used for wireless communication. While the aspects and embodiments that have been described referred to an antenna layout comprising two layers of planar conductors, i.e. planar conductors on a first surface 131 of substrate 130 and planar conductors on a second surface 231 of substrate 130, the antenna may include further layers in between the described layers. The further layers may be referred to as inner layers, as they will be surrounded by at least two further layers. Each inner layer may be arranged between the first surface 131 and the second surface 231 of the substrate 130 and each of the inner layers may include one or more planar conductors that are each coupled to one or more planar conductors of the other inner layers and/or of the surfaces 131 and 231 of the substrate 130, respectively. By providing further layers including further planar conductors, any of the previously described aspects may enable to, for example, increase the bandwidth for which antenna 100 may be tuned, or to further increase the power that may be output by the antenna. Electrically conductive connection among the layers may be enabled by means of one or more vias, such as by vias 160 and 161. Hence, the single grounding leg and feeding leg as has been previously described may also be used to couple an antenna having one or more inner layers to circuitry, such as circuitry of any device or system.

It will be understood that a single antenna that can be incorporated to circuitry of any device by using only one discrete electrical component, i.e. an inductor or a coil, which can still be optimized for reception and transmission of radio signals on at least two different frequency bands which may even have a relatively large bandwidth, which is further optimized for receiving from and transmitting into any direction with minimized absorption and/or reflection of the radio signals when incorporated into a system or device having a relatively small housing and layout and that reduces degradation of the performance of the radiation elements of the antenna over time can be achieved when applying the presently described aspects and embodiments of this disclosure. The antenna layout also minimizes production cost, weight and power consumption and is thus suitable for use in mobile devices or systems. The presently described aspects and embodiments further offer great flexibility for use in different types of devices or systems, as a large number of easily tunable characteristics enable the skilled person to adapt the antenna for reception and transmission on any number of various different frequency bands of wireless communication networks. Even when new standards or wireless communication networks require use of frequency bands that were not previously used, the presently described aspects and embodiments allow easy adaptation.

It will be appreciated that any of the disclosed methods (or corresponding apparatuses, devices, programs, data carriers, etc.) may be carried out by either a host or client, depending on the specific implementation (i.e. the disclosed methods/apparatuses are a form of communication(s), and as such, may be carried out from either 'point of view', i.e. in corresponding to each other fashion). Furthermore, it will be understood that the terms "receiving" and "transmitting" encompass "inputting" and "outputting" and are not limited to an RF context of transmitting and receiving radio waves. Therefore, for example, a chip or other device or component for realizing embodiments could generate data for output to another chip, device or component, or have as an input data from another chip, device or component, and such an output or input could be referred to as "transmit" and "receive" including gerund forms, that is, "transmitting" and "receiving", as well as such "transmitting" and "receiving" within an RF context.

As used in this specification, any formulation used of the style "at least one of A, B or C", and the formulation "at least one of A, B and C" use a disjunctive "or" and a disjunctive "and" such that those formulations comprise any and all joint and several permutations of A, B, C, that is, A alone, B alone, C alone, A and B in any order, A and C in any order, B and C in any order and A, B, C in any order. There may be more or less than three features used in such formulations.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

Unless otherwise explicitly stated as incompatible, or the physics or otherwise the embodiments, example or claims prevent such a combination, the features of the foregoing embodiments and examples, and of the following claims may be integrated together in any suitable arrangement, especially ones where there is a beneficial effect in doing so. This is not limited to only any specified benefit, and instead may arise from an "ex post facto" benefit. This is to say that the combination of features is not limited by the described forms, particularly the form (e.g. numbering) of the example(s), embodiment(s), or dependency of the claim(s). Moreover, this also applies to the phrase "in one embodiment", "according to an embodiment" and the like, which are merely a stylistic form of wording and are not to be construed as limiting the following features to a separate embodiment to all other instances of the same or similar wording. This is to say, a reference to 'an', 'one' or 'some' embodiment(s) may be a reference to any one or more, and/or all embodiments, or combination(s) thereof, disclosed. Also, similarly, the reference to "the" embodiment may not be limited to the immediately preceding embodiment.

As used herein, any machine executable instructions, or compute readable media, may carry out a disclosed method, and may therefore be used synonymously with the term method, or each other.

The foregoing description of one or more implementations provides illustration and description, but is not intended to be exhaustive or to limit the scope of the invention to the precise form disclosed. Modifications and variations are possible in light of the above teachings or may be acquired from practice of various implementations of the present disclosure.

The teachings of all patents, published applications and references cited herein are incorporated by reference in their entirety.

While example embodiments have been particularly shown and described, it will be understood by those skilled in the art that various changes in form and details may be made therein without departing from the scope of the embodiments encompassed by the appended claims.

What is claimed is:

1. An antenna for wireless communication, comprising:

a first planar conductor, which is adapted to resonate at frequencies of a first frequency range;

a second planar conductor, which is adapted to resonate at frequencies of a second frequency range that spans lower frequencies than the first frequency range;

a substrate;

a grounding leg which couples the antenna to ground;

a coil which is conductively coupled to the planar conductors, wherein the coil is arranged on a first surface of the substrate; and a feeding leg which couples the antenna to an electric circuit, wherein the feeding leg is arranged on a second surface of the substrate, wherein the coil is configured to act as at least one of a capacitor for the frequencies of the first frequency range or an inductor for the frequencies of the second frequency range.

2. The antenna according to claim 1, wherein the coil is the only discrete electrical component in the grounding leg of the antenna.

3. The antenna according to claim 1, wherein the coil is one of: a wire-wound type, a planar film type and a multilayer film type; and wherein the distance between neighbouring windings of the coil is configured such that the coil acts as the capacitor for the frequencies of the first frequency range and as the inductor for the frequencies of the second frequency range; and wherein the coil is configured to match an impedance for each of the frequencies of the first and the second frequency ranges; and wherein said impedance has a value of 50Ω.

4. The antenna according to claim 1, further comprising:

a third planar conductor, which is adapted to resonate at frequencies of the first frequency range; and a fourth planar conductor, which is adapted to resonate at frequencies of the second frequency range.

5. The antenna according to claim 4, wherein the first and the second planar conductors are separate from each other and wherein the third and the fourth planar conductors are connected to each other.

6. The antenna according to claim 4, wherein a plurality of vias conductively couple the first planar conductor to the third planar conductor and wherein a plurality of vias conductively couple the second planar conductor to the fourth planar conductor.

7. The antenna according to claim 6, wherein a distance between neighbouring vias of the plurality of vias that conductively couple the first planar conductor to the third planar conductor is at least 40% smaller than a distance between neighbouring vias of the plurality of vias that conductively couple the second planar conductor to the fourth planar conductor.

8. The antenna according to claim 1, wherein the second planar conductor includes a first portion and a second portion conductively coupled to the first portion; and wherein the first portion extends in a first direction and the second portion extends in a second direction.

9. The antenna according to claim 1, wherein the planar conductors have at least one of a rectangular shape or an L-shape.

10. The antenna according to claim 1, wherein at least one of the planar conductors is arranged on the first surface of the substrate and wherein at least another one of the planar conductors is arranged on the second surface of the substrate that is opposite to the first surface.

11. The antenna according to claim 1, wherein the substrate is at least a portion of at least one of a printed circuit board or a ceramic sheet substrate.

12. A system for wireless communication comprising an antenna according to claim 1, wherein the system further comprises a printed circuit board; and wherein the antenna is arranged at a corner of the printed circuit board.

13. The system according to claim 12, wherein the antenna further comprises a third planar conductor, which is adapted to resonate at frequencies of the first frequency range, and a fourth planar conductor, which is adapted to resonate at frequencies of the second frequency range;

wherein the second planar conductor includes a first portion and a second portion conductively coupled to the first portion, wherein the first portion extends in a first direction and the second portion extends in a second direction; and wherein a distal end of second portions of the second and/or the fourth planar conductors is arranged in a distance from a neighbouring edge of the printed circuit board in the first and/or the second direction.

14. The system according to claim 13, wherein a distal end of the first and/or the third planar conductors is arranged in a distance from a neighbouring edge of the printed circuit board in the first and/or the second direction.

15. The system according to claim 13, wherein the first and the second planar conductors are separate from each other and wherein the third and the fourth planar conductors are connected to each other.

16. The system according to claim 13, wherein a plurality of vias conductively couple the first planar conductor to the third planar conductor and wherein a plurality of vias conductively couple the second planar conductor to the fourth planar conductor.

17. The system according to claim 16, wherein a distance between neighbouring vias of the plurality of vias that conductively couple the first planar conductor to the third planar conductor is at least 40% smaller than a distance between neighbouring vias of the plurality of vias that conductively couple the second planar conductor to the fourth planar conductor.

18. The system according to claim 12, wherein the antenna is located at a corner of a housing of the system.

19. The system according to claim 18, wherein the system is any one of a cordless telephone or a cellular telephone.

20. An antenna for wireless communication, comprising:

a first planar conductor, which is adapted to resonate at frequencies of a first frequency range;

a second planar conductor, which is adapted to resonate at frequencies of a second frequency range that spans lower frequencies than the first frequency range;

a third planar conductor, which is adapted to resonate at frequencies of the first frequency range;

a fourth planar conductor, which is adapted to resonate at frequencies of the second frequency range;

a substrate;

a grounding leg which couples the antenna to ground;

a coil which is conductively coupled to the planar conductors, wherein the coil is arranged on a first surface of the substrate; and a feeding leg which couples the antenna to an electric circuit, wherein the feeding leg is arranged on a second surface of the substrate.

* * * * *